United States Patent [19]

Plasko

[11] 4,342,982

[45] Aug. 3, 1982

[54] THERMALLY ACTUATABLE ELECTRICAL SWITCH CONSTRUCTION, CONDUCTIVE LEAD THEREFOR AND METHOD OF MAKING THE SAME

[75] Inventor: Emil R. Plasko, Washington Township, Montgomery County, Ohio

[73] Assignee: Emerson Electric Co., St. Louis, Mo.

[21] Appl. No.: 222,598

[22] Filed: Jan. 5, 1981

[51] Int. Cl.[3] ..... H01H 37/76

[52] U.S. Cl. ..... 337/407; 174/152 R; 337/409; 403/267

[58] Field of Search ..... 337/407, 408, 409; 174/152 R, 165, 170; 339/218 R, 218 C; 403/267, 265, 268, 266

[56] References Cited

U.S. PATENT DOCUMENTS 306,719 10/1884 Clark ..... 174/170
3,770,878 11/1973 Dozier ..... 174/153 R
4,060,787 11/1977 Budnik ..... 337/407

FOREIGN PATENT DOCUMENTS 510363 2/1955 Canada ..... 174/152 R
386305 12/1923 Fed. Rep. of Germany ... 174/152 R
1046171 12/1958 Fed. Rep. of Germany ... 174/152 R

*Primary Examiner*—Harold Broome
*Attorney, Agent, or Firm*—Candor, Candor & Tassone

[57] ABSTRACT

A thermally actuatable electrical switch construction having a housing carrying an electrically insulating end plug provided with an opening passing therethrough and in which a portion of a conductive lead is disposed so that opposite ends of the lead extend beyond opposed ends of the plug and respectively define a fixed contact inside the housing and a terminal outside the housing, the portion of the lead being retained in the opening by a sealing compound disposed in the opening and extending around the portion of the lead and interlocking therewith to tend to prevent axial movement of the lead into the housing as well as to tend to prevent rotational movement of the lead relative to the end plug. The portion of the lead has a series of at least two convolutions that interlock with the sealing compound in the opening of the end plug. The two convolutions respectively have apexes that respectively engage the internal surface of the end plug substantially on opposite sides thereof.

10 Claims, 3 Drawing Figures

THERMALLY ACTUATABLE ELECTRICAL SWITCH CONSTRUCTION, CONDUCTIVE LEAD THEREFOR AND METHOD OF MAKING THE SAME

BACKGROUND OF THE INVENTION

1. Field of the Invention

This invention relates to an improved thermally actuatable electrical switch construction and to a conductive lead therefor as well as to methods of making the same.

2. Prior Art Statement

It is known to provide a thermally actuatable electrical switch construction having a housing means carrying an electrically insulating end plug provided with an opening means passing therethrough and in which a portion of a conductive lead is disposed so that opposed ends of the lead extend beyond opposed ends of the plug and respectively define a fixed contact means inside the housing means and a terminal outside the housing means, the portion of the lead being retained in the opening means by a sealing means disposed in the opening means and extending around the portion of the lead and interlocking therewith to tend to prevent axial movement of the lead into the housing means as well as to tend to prevent rotational movement of the lead relative to the end plug.

For example, see the following item:

(1) U.S. Pat. No., 4,060,787—Budnik

It appears that the portion of the lead that is disposed in the opening means of the end plug of the thermally actuatable electrical switch construction of item (1) above is provided with a plurality of radially disposed reliefs deformed into the portion of the lead in a manner to prevent each relief from extending around the entire circumference of the lead so as to cause the sealing means to enter the reliefs and form set blocks of sealing means that tend to prevent axial movement of the lead into the housing means as well as to tend to prevent rotational movement of the lead relative to the end plug.

It is also known to hermetically seal an electrical terminal pin in a sleeve-like opening of a supporting body by means of a molded dielectric sealing member which coacts with the terminal pin and the supporting body.

For example, see the following item:

(2) U.S. Pat. No. 3,770,878—Dozier

It appears that the terminal pin of the arrangement of item (2) is provided with a plurality of axially disposed shoulders to provide means for coacting with the molding material to tend to prevent axial movement therebetween (see column 5, lines 24–26) and is provided with a roughened surface or a knurled surface on an annular reduced portion thereof to tend to prevent rotational movement therebetween (see column 5, lines 35 and 36).

SUMMARY OF THE INVENTION

It is also known to provide convolutions in elongated members to anchor the same with a sealing compound in an opening of a structure carrying the same.

For example, see the following two items:

(3) U.S. Pat. No. 306,719—Clark (4) German Pat. No. 386,305.

It is one feature of this invention to provide an improved thermally actuatable electrical switch construction wherein the conductive lead that is carried in an opening means of an insulating end plug is interlocked to the sealing means that is disposed in the opening means of the end plug and surrounds the portion of the lead therein to tend to prevent axial movement of the lead into the housing means that carries the end plug as well as to tend to prevent rotational movement of the lead relative to the end plug.

In particular, it has been found to be advantageous to interlock the conductive lead of a thermally actuatable electrical switch construction in the opening means of the end plug carrying the same with the epoxy resin that flows by capillary action or other means into the opening means around the lead as the epoxy resin is being disposed on an external portion of the conductive casing, a projecting portion of the end plug and a terminal portion of the lead extending out of the end plug to hermetically seal the lead to the casing and thereby prevent air from entering the casing through the insulating end plug.

For example, see the aforementioned U.S. Pat. No. to Budnik, 4,060,787 for a teaching of some of the reasons for so interlocking the conductive lead with the sealing compound in the opening means of the end plug of a thermally actuatable switch construction as well as for a teaching of a method for so forming a lead and thereafter interlocking the same, the U.S. Patent to Budnik being incorporated into this disclosure by reference thereto.

However, it is believed according to the teachings of this invention that the conductive lead of a thermally actuatable electrical switch construction can be formed in another unique manner to interlock with the sealing compound in a manner to be effective in preventing axial movement of the lead in the opening means of the end plug as well as preventing rotational movement therebetween.

In particular, it is believed according to the teachings of this invention that the portion of the lead that is to be disposed in the opening means of the end plug of the thermally actuatable electrical switch construction can be deformed in a manner to provide a series of at least two convolutions therein which will interlock with the sealing means subsequently disposed and set in the opening means of the end plug.

For example, one embodiment of this invention provides a thermally actuatable electrical switch construction having a housing means carrying an electrically insulating end plug provided with an opening means passing therethrough and in which a portion of a conductive lead is disposed so that opposed ends of the lead extend beyond opposed ends of the plug and respectively define a fixed contact inside the housing means and a terminal outside the housing means, the portion of the lead being retained in the opening means by a sealing means disposed in the opening means and extending around a portion of the lead and interlocking therewith to tend to prevent axial movement with the lead into the housing means as well as to tend to prevent rotational movement of the lead relative to the end plug. The portion of the lead has a series of at least two convolutions therein that interlock with the sealing means in the opening means of the end plug. The opening means in the end plug defines an internal surface means of the end plug. The two convolutions respectively have apexes that respectively engage the internal surface means substantially on opposite sides thereof.

Accordingly, it is an object of this invention to provide an improved thermally actuatable electrical switch construction having one or more of the novel features of this invention as set forth above or hereinafter shown or described.

Another object of this invention is to provide a method of making such a thermally actuatable electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
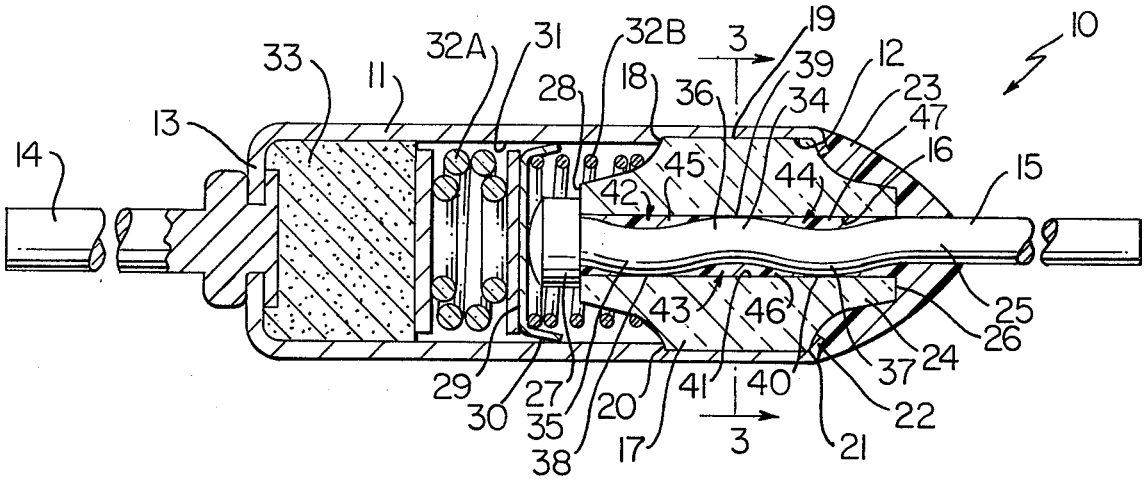
FIG. 1 is a cross-sectional view of the improved thermally actuatable electrical switch construction of this invention.
Figure 2:
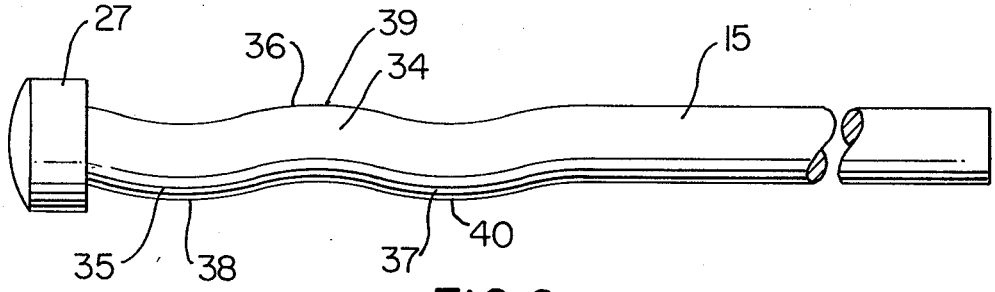
FIG. 2 is an enlarged side view of the improved conductive lead of this invention that is utilized in the thermally actuatable electrical switch construction of FIG. 1.
Figure 3:
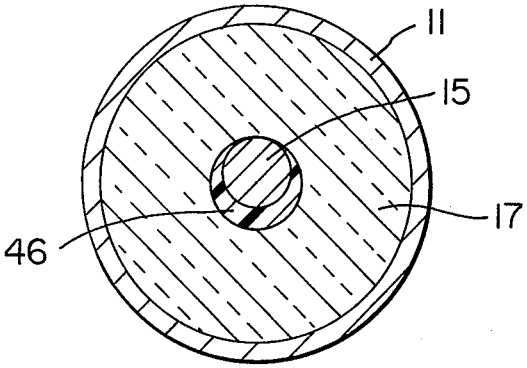
FIG. 3 is an enlarged cross-sectional view taken on line 3—3 of FIG. 1.

While the various features of this invention are hereinafter described and illustrated as being particularly adapted to provide a thermally actuatable electrical switch construction, it is to be understood that the various features of this invention can be utilized singly or in any combination thereof to provide other types of electrical switch construction as desired.

Therefore, this invention is not to be limited to only the embodiments illustrated in the drawings, because the drawings are merely utilized to illustrate one of the wide variety of uses of this invention.

Referring now to FIG. 1, the improved thermally actuatable electrical switch construction of this invention is generally indicated by the reference numeral 10 and is substantially of the same type and construction as the thermally actuatable electrical switch construction disclosed and claimed in the U.S. Pat. No. to Merrill, 3,519,972 and such U.S. Patent to Merrill is being incorporated into this disclosure by reference thereto for setting forth the details of the structure and operation of the thermally actuatable electrical switch construction 10 of this invention. Therefore, it is only necessary to describe certain details of the thermally actuatable electrical switch construction 10 to understand the features of this invention.

In particular, the thermally actuatable electrical switch construction 10 includes an electrically conductive casing or housing means 11 formed of metallic material and having an open end 12 and a closed end 13 secured to an electrically conductive lead or terminal 14 while another electrically conductive lead 15 is carried in opening means 16 of an electrically insulating end plug 17 secured in the open end 12 of the casing or housing means 11 by having one end 18 of a cylindrical portion thereof abutting a shoulder 20 of the casing 11 and the other end 21 being held by a turned over end 22 of the casing 11 whereby the end plug 17 is fixed in the open end 12 of the casing 11 and is hermetically sealed thereto by a suitable epoxy resin 23 being disposed on the exterior of the casing 11 at the turned end 22 thereof and over a projecting cone portion 24 of the end plug 17 and onto the end 25 of the lead 15 that projects beyond the adjacent end 26 of the end plug 17 as illustrated whereby the uncovered part of the end 25 of the lead 15 defines a terminal for the thermally actuatable electrical switch construction 10.

The lead 15 has an enlarged arresting head 27 that projects beyond the end 28 of the end plug 17 and bears against the same outboard of the opening means 16 to define a fixed contact within the casing 11 that is normally engaged by a movable disc-like contact member 29 that has outer peripheral resilient fingers 30 disposed in sliding and electrical contact with the internal peripheral surface 31 of the casing 11 as illustrated, the movable contact 29 normally being held in conductive contact with the fixed contact 27 by a compression spring 32A normally held in the compressed condition illustrated in FIG. 1 by a temperature sensitive member 33 that remains in the solid condition illustrated in FIG. 1 as long as the same is sensing a temperature below a predetermined temperature. However, when the temperature sensed by the member 33 exceeds the predetermined temperature thereof, the member 33 melts and thereby premits the compression spring 32A to expand so that a normally weaker compression spring 32B disposed between the end plug 17 and the movable contact member 29 can expand and move the movable contact 29 out of contact with the fixed contact 27.

Therefore, it can be seen that as long as the temperature sensing member 33 is in the solid condition illustrated in FIG. 1, an electrical circuit can be completed between the terminals 14 and 25. However, once the temperature sensitive member 33 melts, the force of the compression spring 32B now moves the movable contact 29 out of contact with the fixed contact 27 and holds the same out of contact with the fixed contact 27 so that the electrical circuit between the terminals 14 and 25 is permanently interrupted by the thermally actuated electrical switch construction 10.

As set forth in the aforementioned U.S. Pat. No. to Budnik, 4,060,787, it is desired to prevent someone from attempting to push axially inwardly on the lead 15, after the thermally actuatable switch construction 10 has been thermally actuated in the manner previously described, and break the bond between the epoxy resin 23 and the lead 15 so as to move the lead 15 into the casing 11 to again contact the fixed contact 27 against the movable contact 29. This could be accomplished by the person pushing inwardly on the lead 15 with sufficient force to break the bond between the epoxy resin 23 that has seeped into the bore or opening means 16 around the lead 15 or by that person first tending to rotate the lead 15 relative to the end plug 17 and thereby breaking such bond so as to thereafter push axially inwardly on the lead 15.

As previously stated, it is a feature of this invention to provide unique interlocking means between the lead 15 of this invention and the epoxy resin 23 that is disposed in the opening means 16 of the end plug 17.

In particular, it is believed that if the portion 34 of the lead 15 that will be subsequently disposed in the substantially cylindrical opening means 16 of the end plug 17 is initially deformed to define at least one convolution 35, 36 or 37 as illustrated and has a diameter sufficiently smaller than the diameter of the opening means 16, the portion 34 of the lead 15 when subsequently disposed in the opening means 16 will have one or more of the apexes 38, 39 and 40 of the convolutions 35, 36 and 37 bearing against the internal peripheral surface 41 of the end plug 17 and on opposite sides of the longitudinal axis of the opening means 16 so as to define one or more enlarged irregularly shaped areas or pockets 42, 43 and 44 within the opening means 16 and in which the epoxy resin 23 will seep or flow and subsequently form set irregular blocks 45, 46 and 47 of hardened resin material that are substantially firmly bonded to the internal peripheral surface 41 of the end plug 17.

The irregularly shaped set blocks 45, 46 and 47 of hardened epoxy resin material 23 now provide a wedging action that tends to prevent the axial inward movement of the portion 34 of the lead 15 into the casing 11 as well as tends to prevent rotational movement of the portion 34 of the lead 15 relative to the end plug 17 so that in order to either rotate the portion 34 of the lead 15 or move the same axially inwardly in the opening means 16 toward the interior of the casing means 11 requires the set blocks 45, 46 and 47 to either be deformed or fractured or the portion 34 of the lead 15 itself to be deformed to provide for such relative movement.

Therefore, it is believed that by forming one or more of the convolutions 35, 36 and 37 in the portion 34 of the lead 15 before the same is inserted into the opening means 16 of the end plug 17 to be secured therein by the epoxy resin 23 in the manner previously described, the lead 15 will be more secured in the end plug 17 from axial movement therein as well as from rotational movement relative thereto than if the portion 34 of the lead 15 was substantially smooth and straight as in the aforementioned U.S. Patent to Merrill.

While the convolutions 35, 36 and 37 can be formed in the portion 34 of the lead 15 in any suitable manner, it is believed that the same can be formed therein at the same time the enlarged head 27 is being formed on the lead 15 by a cold forming operation, the portion 34 of the lead normally being held in cooperating anvil-like jaws of the cold forming apparatus while the enlarged head 27 is being formed by a cold upsetting of the extending portion of the lead 15 beyond the holding jaws.

However, it is to be understood that this invention is not to be limited to any manner of forming the convolutions 35, 36 and 37 and it may be found that only one convolution is required or that a plurality of such convolutions are required.

Since the operation of the completed thermally actuatable electrical switch construction 10 of this invention has been previously described, it is deemed unnecessary to repeat such operation thereof.

Nevertheless, it can be seen that either after or even before the temperature sensitive member 33 has melted, a person cannot readily push axially inwardly on the lead 15 nor tend to rotate the lead 15 relative to the end plug 17 because of the hardened blocks 45, 46 and 47 of the set epoxy resin 23 that had previously seeped or otherwise entered into the opening means 16 during the disposing of the epoxy resin 23 on the outer end of the thermally actuatable electrical switch construction 10 to hermetically seal the lead 15 and open end 12 of the casing 11 in the manner perviously described.

Therefore, it can be seen that this invention not only provides an improved thermally actuatable electrical switch construction and an improved conductive lead therefor, but also this invention provides improved methods of making such a thermally actuatable electrical switch construction and such a conductive lead therefor.

While the forms and methods of this invention have been illustrated and described as required by the Patent Statute, it is to be understood that other forms and method steps can be utilized and still fall within the scope of the appended claims.

What is claimed is:

1. In a thermally actuatable electrical switch construction having a housing means carrying an electrically insulating end plug provided with an opening means passing therethrough and in which a portion of a conductive lead is disposed so that opposed ends of said lead extend beyond opposed ends of said plug and respectively define a fixed contact means inside said housing means and a terminal outside said housing means, said portion of said lead being retained in said opening means by a sealing means disposed in said opening means and extending around said portion of said lead and interlocking therewith to tend to prevent axial movement of said lead into said housing means as well as to tend to prevent rotational movement of said lead relative to said end plug, the improvement wherein said portion of said lead has a series of at least two convolutions therein that interlock with said sealing means in said opening means of said end plug, said opening means in said end plug defining an internal surface means of said end plug, said two convolutions respectively having apexes that respectively engage said internal surface means substantially on opposite sides thereof.

2. A thermally actuatable electrical switch construction as set forth in claim 1 wherein said portion of said lead has a third convolution having its apex engaging said internal surface means of said end plug.

3. A thermally actuatable electrical switch construction as set forth in claim 2 wherein said series of three convolutions has the apexes of the two outboard convolutions thereof engaging one of said opposite sides of said internal surface means of said end plug and the apex of the medial convolution thereof engaging the other of said opposite sides of said surface means of said end plug.

4. A thermally actuatable electrical switch construction as set forth in claim 1 wherein said opening means in said end plug passes substantially longitudinally therethrough and has a substantially uniform circular cross section throughout the longitudinal length thereof.

5. A thermally actuatable electrical switch construction as set forth in claim 4 wherein said portion of said lead has a substantially uniform circular cross section throughout the longitudinal length thereof.

6. In a method of making a thermally actuatable electrical switch construction having a housing means carrying an electrically insulating end plug provided with an opening means passing therethrough and in which a portion of a conductive lead is disposed so that opposed ends of said lead extend beyond opposed ends of said plug and respectively define a fixed contact means inside said housing means and a terminal outside said housing means, said portion of said lead being retained in said opening means by a sealing means disposed in said opening means and extending around said portion of said lead and interlocking therewith to tend to prevent axial movement of said lead into said housing means as well as to tend to prevent rotational movement of said lead relative to said end plug, the improvement comprising the steps of deforming said portion of said lead to form a series of at least two convolutions therein that interlock with said sealing means in said opening means of said end plug, forming said opening means in said end plug to define an internal surface means of said end plug, and engaging the apexes of said two convolutions respectively against said internal surface means and substantially on opposite sides thereof.

7. A method of making a thermally actuatable electrical switch construction as set forth in claim 6 and including the steps of forming said portion of said lead to have a third convolution in said series thereof, and engaging the apex of said third convolution of said portion of said lead against said internal surface means of said end plug.

8. A method of making a thermally actuatable electrical switch construction as set forth in claim 7 wherein said steps of forming said convolutions and engaging said apexes thereof causes the apexes of the two outboard convolutions in said series thereof to engage one of said opposite sides of said internal surface means of said end plug and the apex of the medial convolution in said series thereof to engage the other of said opposite sides of said internal surface means of said end plug.

9. A method of making a thermally actuatable electrical switch construction as set forth in claim 6 and including the step of forming said opening means in said end plug to pass substantially longitudinally therethrough and have a substantially uniform circular cross section throughout the longitudinal length thereof.

10. A method of making a thermally actuatable electrical switch construction as set forth in claim 9 and including the step of forming said portion of said lead to have a substantially uniform circular cross section throughout the longitudinal length thereof.

* * * * *